US009707431B1

(12) United States Patent
Haley

(10) Patent No.: US 9,707,431 B1
(45) **Date of Patent: *Jul. 18, 2017**

(54) VARIABLE WEIGHT TONING STRAP

(71) Applicant: Better Way Inventions, LLC, Boynton Beach, FL (US)

(72) Inventor: Stephen C. Haley, Boynton Beach, FL (US)

(73) Assignee: Better Way Inventions, LLC, Boynton Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/459,968

(22) Filed: Mar. 15, 2017

Related U.S. Application Data

(63) Continuation of application No. 14/997,709, filed on Jan. 18, 2016, now Pat. No. 9,604,091, which is a (Continued)

(51) Int. Cl.
*A63B 21/065* (2006.01)
*A63B 23/16* (2006.01)
(Continued)

(52) U.S. Cl.
CPC ..... *A63B 21/065* (2013.01); *A63B 21/0004* (2013.01); *A63B 21/00065* (2013.01);
(Continued)

(58) Field of Classification Search
CPC ..... A63B 21/1419; A63B 21/4013; A63B 21/4021; A63B 21/4023; A63B 21/4025;
(Continued)

(56) References Cited

U.S. PATENT DOCUMENTS 1,074,939 A * 10/1913 Fredrikson ..... A63B 21/065 482/105
3,532,339 A * 10/1970 Smith ..... A63B 21/065 482/105

(Continued)

FOREIGN PATENT DOCUMENTS

WO 2015117183 A1 8/2015

*Primary Examiner* — Joshua Lee
(74) *Attorney, Agent, or Firm* — Mark C. Johnson; Johnson|Dalal

(57) ABSTRACT

A variable weight toning strap having a flexible member and a plurality of generally rectangular sections, wherein each of the plurality of generally rectangular sections are disposed transversely along the flexible member length, include a top surface at least partially defining an upper surface of the flexible member, at least one perpendicular sidewall extending in a direction substantially perpendicular to the top surface, and a section width separating a rear face and a front face of the sections. Two of the sections have a discontinuous upper slit defined by the at least one perpendicular sidewall of each of said sections flanking the upper slit, wherein the upper slit spans the section width and terminates into a valley. The sections also each define a channel with a selectively removably and frictionally retained weight disposed therein.

19 Claims, 12 Drawing Sheets

Related U.S. Application Data continuation-in-part of application No. 13/793,473, filed on Mar. 11, 2013, now Pat. No. 9,302,141.

(60) Provisional application No. 61/609,449, filed on Mar. 12, 2012.

(51) Int. Cl.

| | |
|---|---|
| ***A63B 21/06*** | (2006.01) |
| ***A63B 71/00*** | (2006.01) |
| ***A63B 21/00*** | (2006.01) |
| ***A63B 24/00*** | (2006.01) |
| *A63B 23/12* | (2006.01) |

(52) U.S. Cl.

CPC ..... *A63B 21/4021* (2015.10); *A63B 24/0087* (2013.01); *A63B 23/1209* (2013.01); *A63B 71/0036* (2013.01)

(58) Field of Classification Search

CPC ..... A63B 21/4039; A63B 21/4043; A63B 2053/0491; A63B 21/075; A63B 2225/68; A63B 2225/687; A63B 21/0004; A63B 21/00061; A63B 21/00065; A63B 21/00076; A63B 2210/50; A63B 71/0036; A63B 21/06; A63B 21/0609; A63B 21/065; A63B 23/03508; A63B 23/14; A63B 24/00; A63B 24/0087; A63B 2071/0661; A63B 2071/0663

See application file for complete search history.

(56) References Cited

U.S. PATENT DOCUMENTS 3,924,851 A * 12/1975 Winston ..... A63B 21/065 482/105
4,239,211 A * 12/1980 Wilkerson ..... A63B 21/065 156/301
4,384,714 A * 5/1983 Kimura ..... A63B 21/065 482/105
4,623,143 A * 11/1986 Wuellenweber ..... A63B 21/065 482/105
4,830,154 A * 5/1989 Gerch ..... A45C 3/00 190/103
4,838,546 A * 6/1989 Winston ..... A63B 21/4013 482/105
4,899,887 A * 2/1990 Cachero ..... A63B 71/0036 190/1
4,966,365 A * 10/1990 Winston ..... A63B 21/065 482/105
4,988,097 A 1/1991 Smith et al.
4,997,183 A * 3/1991 Winston ..... A63B 21/065 482/105
5,075,902 A * 12/1991 McReynolds ..... A63B 21/065 2/227
5,076,575 A * 12/1991 Eylander ..... B63C 11/30 405/186
5,127,891 A * 7/1992 Winston ..... A63B 21/065 482/105
5,514,056 A * 5/1996 Ronca ..... A63B 21/0607 482/105
5,607,378 A * 3/1997 Winston ..... A63B 21/4017 482/105
5,868,652 A * 2/1999 Spletzer ..... A63B 21/0605 2/22
6,039,677 A * 3/2000 Spletzer ..... A63B 21/0605 2/22
6,113,521 A * 9/2000 Winston ..... A63B 21/065 482/105
6,200,243 B1 * 3/2001 Meranto ..... A63B 21/0602 150/150
6,671,887 B1 * 1/2004 Eligan ..... A63B 21/4009 2/228
7,022,095 B2 * 4/2006 Schneider ..... A63B 71/14 482/105
D526,691 S * 8/2006 Fu ..... D21/683
7,090,624 B1 * 8/2006 Chrishon ..... A63B 21/0601 482/105
7,211,031 B1 * 5/2007 Soloviev ..... A63B 21/0602 482/105
7,895,675 B2 * 3/2011 Curphey ..... A63B 21/065 2/338
8,550,243 B2 * 10/2013 Moore ..... A45C 13/02 206/315.1
2003/0186789 A1 * 10/2003 Cook ..... A63B 21/065 482/105
2004/0043875 A1 * 3/2004 Lederfeind ..... A63B 21/4009 482/105
2004/0209711 A1 * 10/2004 Liberatore ..... A63B 15/00 473/457
2007/0049854 A1 * 3/2007 Teimourian ..... A61F 5/028 602/19
2007/0099774 A1 * 5/2007 Bruback ..... A63B 21/0602 482/105
2008/0023355 A1 * 1/2008 Reynolds ..... A63B 71/0036 206/315.1
2008/0179214 A1 * 7/2008 Hall ..... A63B 71/0036 206/579
2009/0253560 A1 * 10/2009 Cook ..... A63B 21/065 482/105
2010/0000006 A1 * 1/2010 Butler ..... A63B 21/0605 2/160
2010/0187382 A1 * 7/2010 Cook ..... A47G 25/0664 248/188.91

* cited by examiner

VARIABLE WEIGHT TONING STRAP

CROSS-REFERENCE TO RELATED APPLICATION

This application claims priority to pending U.S. Nonprovisional patent application Ser. No. 14/997,709, filed Jan. 18, 2016, which claims priority U.S. Nonprovisional patent application Ser. No. 13/793,473, filed Mar. 11, 2013, now U.S. Pat. No. 9,302,141 which claims priority to U.S. Provisional Patent Application No. 61/609,449 filed Mar. 12, 2012, the entirety of the above are incorporated herein by reference.

FIELD OF THE INVENTION

The present invention relates generally to weighted bracelets, and, more particularly, relates removable variable weight bracelets.

BACKGROUND OF THE INVENTION

Obesity is a medical condition in which excess body fat has accumulated to the extent that it may have an adverse effect on health, leading to reduced life expectancy and/or increased health problems. Obesity increases the likelihood of various diseases, particularly heart disease, Type 2 diabetes, obstructive sleep apnea, certain types of cancer, and osteoarthritis. Obesity is most commonly caused by a combination of excessive food energy intake, lack of physical activity, and genetic susceptibility, although a few cases are caused primarily by genes, endocrine disorders, medications or psychiatric illness. Obesity is a leading preventable cause of death worldwide, with increasing prevalence in adults and children, and authorities view it as one of the most serious public health problems of the 21st century.

Dieting and physical exercise are the mainstays of treatment for obesity. Physical exercise is any bodily activity that enhances or maintains physical fitness and overall health and wellness. Physical exercise is performed for various reasons including strengthening muscles and the cardiovascular system, honing athletic skills, weight loss or maintenance, as well as for the purpose of enjoyment. Frequent and regular physical exercise boosts the immune system, and helps prevent the "diseases of affluence' such as heart disease, cardiovascular disease, Type 2 diabetes and obesity. Physical exercise also improves mental health, helps prevent depression, helps to promote or maintain positive self-esteem, and can even augment an individual's sex appeal or body image which have also been found to be linked with higher levels of self-esteem.

Strength training is the use of resistance to muscular contraction to build the strength, anaerobic endurance, and size of skeletal muscles. When properly performed, strength training can provide significant functional benefits and improvement in overall health and well-being including increased bone, muscle, tendon and ligament strength and toughness, improved joint function, reduced potential for injury, increased bone density, a temporary increase in metabolism, improved cardiac function, and elevated HDL (good) cholesterol. Training commonly uses the technique of progressively increasing the force output of the muscle through incremental increases of weight, elastic tension or other resistance, and uses a variety of exercises and types of equipment to target specific muscle groups.

Toning exercises are physical exercises that are used with the aim of developing a physique with a large emphasis on musculature. In this context, the term toned implies leanness in the body (low levels of body fat), noticeable muscle definition and shape, but not significant muscle size ("bulk"). Appearing "toned" is a common fitness goal, particularly associated with women.

In today's hectic society, many individuals have a difficult time sticking to an exercise regimen.

Previously, the use of wrist weights is a form of resistance training, generally a kind of weight training. In addition to the greater effect of gravity on the person, wrist weights add resistance during ballet movements, due to more force needed to overcome the inertia of heavier masses, as well as a greater momentum that needs deceleration at the end of the movement to avoid injury. The method may increase muscle mass or enhance the loss of weight: however, there have been concerns about the safety of some uses of weights, such as wrist and ankle weights. Wrist and ankle weights have heretofore been provided in the form of small weights, attached to increase endurance when performed in long repetitive events, such as running, swimming, punching, kicking or jumping.

Most, if not all of, wrist weights are heavy enough to immediately add a good amount of stress on joints and tendons. Previously, wrist weights were geared for use during a specific exercise or workout. Wrist weights are not light enough or even meant to be used all day, every day. Moreover, those known wrist weights are also cumbersome, uncomfortable to many users using the wrist weights in activities, such as workout routines, and inhibit the user from experiencing a full range-of-motion for his or arms/wrists. Furthermore, those known wrist weights are also are very limited in application or versatility, thereby limiting their utility.

Therefore, a need exists to overcome the problems with the prior art as discussed above.

SUMMARY OF THE INVENTION

The invention provides a variable weight toning strap that overcomes the hereinafore-mentioned disadvantages of the heretofore-known devices and methods of this general type. The present invention permits users to add various amounts of weight to the strap, while employing a configuration that enables the strap to conform to a user's arm or other extremity while the user is engaged in exercising, sports, day-to-day movements, and other activities. The present invention also enables users to employ a variable weight toning assembly, while also providing users the ability interchange a variety of components or devices, such as an electronic display, advertising indicia, or personalized user-content, to effectuate a customized configuration desired by the user.

In accordance with the present invention, a variable weight toning strap, bracelet, or wristband is disclosed that includes flexible member having an upper surface, a bottom surface, a first end, a second end opposing the first end, and a flexible member length separating the first and second ends of the flexible member, wherein the upper and bottom surfaces span the flexible member length. The invention also includes a plurality of generally rectangular or ridged sections that are raised above a strap portion of the strap and are disposed transversely along the flexible member length, also include a top surface that at least partially defines the upper surface of the flexible member, have at least one perpendicular sidewall extending in a direction substantially perpendicular to the top surface, have a front face, have a rear face opposing the front face, and have a section width separating the rear face and the front face. These ridged-sections also have a discontinuous upper slit defined by the at least one perpendicular sidewall of each of the plurality of generally rectangular sections flanking the upper slit, wherein the upper slit spans the section width of each the plurality generally rectangular sections defining the upper slit and terminate into a valley that at least partially defines the upper surface of the flexible member. Each of the ridged-sections also define one or more channels spanning transversely along the flexible member length in direction from the front face to the rear face of each of the plurality of ridged-sections so as to accommodate one or more, or a plurality, of weights, wherein each of the weights are selectively removably and frictionally retained by the respective one or more channels of each of the plurality of ridged-section sections.

In accordance with another feature, an embodiment of the present invention also includes at least one discontinuous lower slit defined by the bottom surface of the flexible member, wherein the lower slit spans a transverse width separating a front face and a rear face of the flexible member and aligned with the upper slit to provide a user with flexibility and comfort when the strap is in use, especially during extreme workout routines having a required high range of motion for a user's wrist and/or arm.

In accordance with a further feature of the present invention, the flexible member and the plurality of generally rectangular sections are unitary.

In accordance with yet another feature, an embodiment of the present invention also includes the plurality of generally rectangular sections each having a flange disposed within each of the respective plurality of channels and at least partially defining the front face of the respective plurality of generally rectangular sections, wherein the flange restricts lateral movement of one of the respective plurality of weights removably and frictionally retained therein to prevent inadvertent release of the weight from the strap.

In accordance with an additional feature of the present invention, the plurality of generally rectangular sections each define one or more entrance apertures on the front face of the plurality of generally rectangular sections and one or more exit apertures on the rear face of the plurality of generally rectangular section, wherein the entrance and exit apertures are disposed at respective ends of the plurality of channels to permit entrance and egress of the plurality of weights.

In accordance with another feature, an additional embodiment of the present invention also includes the plurality of weights each including a longitudinal axis defined by at least one point defined by at least one of a centroid and center of mass of the respective plurality of weights, the longitudinal axis of two of the plurality of weights removably frictionally retained by the plurality of channels of one of the plurality of generally rectangular sections are parallel and coplanar with one another.

In accordance with an additional feature, an additional embodiment of the present invention also includes (1) a generally rectangular modular section disposed transversely along the flexible member length and also including a top surface at least partially defining the upper surface of the flexible member, at least one perpendicular sidewall extending in a direction substantially perpendicular to the top surface of the modular section, a front face, a rear face opposing the front face of the modular section, and a section width separating the rear face and the front face of the modular section, wherein the modular section defines an internal cavity and (2) an electronic control unit ("ECU") assembly disposed within the internal cavity of the modular section and having a digital display with top surface at least partially defining the upper surface of the flexible member and a power source electrically coupled to the display.

In accordance with another feature, an additional embodiment of the present invention includes the electronic control unit assembly having an ECU housing shaped and sized to correspond to the internal cavity of the modular section, wherein the ECU housing selectively removably and frictionally retained by the modular section. The modular section may also have a rim, track, flange, or other structure to facilitate in the retention of the ECU housing.

In accordance with an additional feature, another embodiment of the present invention includes (1) a generally rectangular modular section disposed transversely along the flexible member length and includes a top surface at least partially defining the upper surface of the flexible member, at least one perpendicular sidewall extending in a direction substantially perpendicular to the top surface of the modular section, a front face, a rear face opposing the front face of the modular section, and a section width separating the rear face and the front face of the modular section, wherein the modular section defines an internal cavity and (2) a modular section insert having an upper surface shaped and sized to be selectively removably and frictionally retained by the modular section, wherein the modular section insert includes a partition wall disposed at a substantially perpendicular orientation with respect to the upper surface of the module section insert.

In accordance with a further feature, an embodiment of the present invention also includes the partition wall of the modular section insert having opposing symmetrical side surfaces shaped to at least partially contour a plurality of weights housed within the internal cavity of the modular section.

In accordance with yet another feature, an embodiment of the present invention also includes the generally rectangular modular section also having a plurality of entrance apertures defined by the front face of the modular section and a plurality of exit apertures defined by the rear face of the modular section, wherein the plurality of entrance and exit apertures of the modular section providing entrance and egress of the internal cavity of the modular section.

In accordance with the present invention, a variable weight toning strap is also disclosed that includes a flexible member enclosing a wrist-arm area of a user to define a wearing position with a circumferential member length, the flexible member having a bottom surface in a user-contacting configuration with the user and an upper surface opposing the bottom surface, a plurality of ridged-sections disposed in a raised position transversely along at least 75% of the circumferential member length, and a plurality of weights, each selectively removably frictionally retained, respectively, by at least one channel of each of the plurality of ridged-sections. As such, the plurality of ridged-sections each have a top surface at least partially defining the upper surface of the flexible member, at least one perpendicular sidewall extending in a direction substantially perpendicular to the top surface, a front face, and a rear face opposing the front face. They each also define at least one channel spanning transversely along the circumferential member length in direction from the front face of the ridged-section to the rear face of the ridged-section. Two of the plurality of ridged-sections also define a discontinuous upper slit by the at least one perpendicular sidewall of the two of the plurality of ridged-sections flanking the upper slit, wherein the upper slit spans from the front and rear faces of the two of the plurality of ridged-sections defining the upper slit and terminating into a valley that at least partially defines the upper surface of the flexible member.

In accordance with the present invention, a variable weight toning strap is also disclosed that has (1) a flexible member having an upper surface, a bottom surface, a first end, a second end opposing the first end, and a flexible member length separating the first and second ends of the flexible member, wherein the upper and bottom surfaces spans the flexible member length; (2) a plurality of ridged-sections disposed in a raised position along the flexible member length, wherein the plurality of ridged-sections: (i) are disposed transversely along the flexible member length, (ii) include a top surface at least partially defining the upper surface of the flexible member, at least one perpendicular sidewall extending downwardly from the top surface of the ridged-section, a front face, a rear face opposing the front face, and a section width separating the rear face and the front face, (iii) have a discontinuous upper slit defined by the at least one perpendicular sidewall of each of the plurality of ridged-sections flanking the upper slit, the upper slit spanning the section width of each the plurality ridged-sections defining the upper slit and terminating into a valley that at least partially defines the upper surface of the flexible member, and (iv) define a plurality of channels spanning transversely along the flexible member length in direction from the front face to the rear face of each of the plurality of ridged-sections; (3) a plurality of weights, wherein each of the weights are selectively removably and frictionally retained by the respective plurality of channels of each of the plurality of ridged-sections; (4) a ridged-modular section disposed in a raised position along the flexible member length and including a top surface at least partially defining the upper surface of the flexible member, at least one perpendicular sidewall extending in a direction substantially perpendicular to the top surface of the ridged-modular section, a front face, a rear face opposing the front face of the ridged-modular, and a section width separating the rear face and the front face of the ridged-modular section, the ridged-modular defining an internal cavity; and (5) an electronic control unit (ECU) assembly disposed within the internal cavity of the modular section and having a digital display with top surface at least partially defining the upper surface of the flexible member and a power source electrically coupled to the display.

Although the invention is illustrated and described herein as embodied in a variable weight toning strap, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the strap spanning from the distal and proximal ends.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
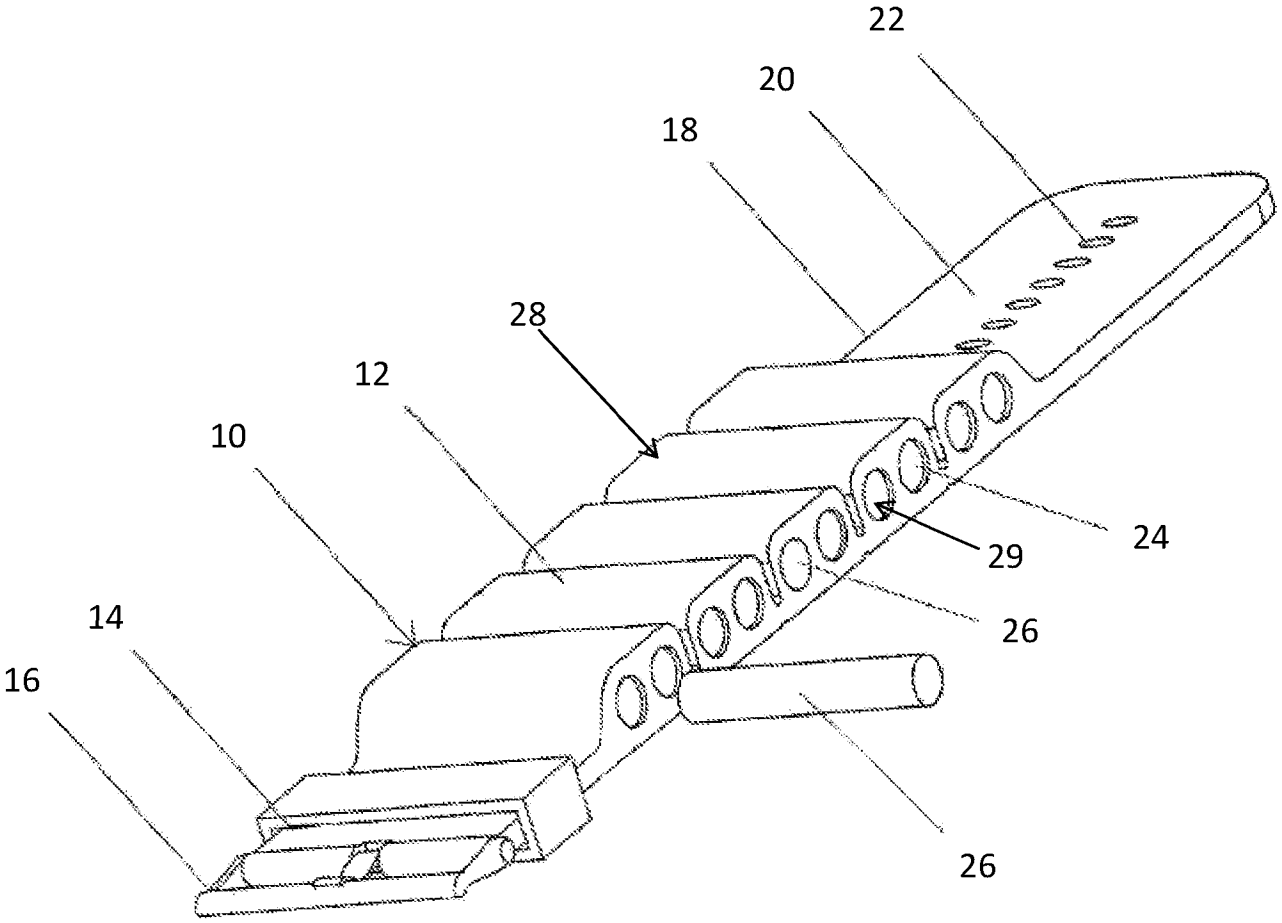
FIG. 1 is a perspective, partially exploded view of a variable weight toning strap with one weight bar in place and a second weight bar indicated as being either inserted into or removed from the strap.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient variable weight toning strap. Referring to the drawings, a variable weight toning strap 10 is shown depicted as an elongated articulated member having a plurality of preferably elongated generally rectangular sections 12 preferably extending transversely of the length of the strap 10. Each of section 12 can be seen preferably thicker (top to bottom) than the remainder of the strap 10 and are essentially of the same width as the strap 10. There are spaces or gaps transversely of the length of the strap between each of the sections 12, thus the strap 10 may be flexed between adjacent sections. One end 14 of the strap may include a buckle 16 and the other end 18 of the strap may include a tab 20. The strap 10 includes a series of apertures 22 such that when the tab is inserted into the buckle 16, a portion of the buckle 16 extends into one of the apertures to secure the strap 10. Alternate forms of fastening the two ends of the strap 10 such as hook-and-loop fasteners, as a non-limiting example, may be used. Alternatively, the two ends may be permanently coupled or joined together, such that the user would insert his or her hand or other extremity into the aperture formed by the strap 10. The strap 10 may be shaped and sized such that it is elastically deformed for insertion of the user's wrist/arm and, when the forced used to elastically deform the strap 10 is removed, the compression forces keep the strap 10 retained on the wrist/arm of the user.

The strap 10 may be of appropriate length for the wrist, arm, ankle, leg, or any other part of the body of the user. At least two sections 12 should be provided although it is preferable to have sections 12 generally along the full length of the strap 10 since a larger number of sections 12 tend to enhance the benefit from use of the variable weight toning strap 10. The apertures provide for adjustability of the effective length of the strap, i.e., the portion of the strap which could be in contact with the arm or leg of the wearer.

At least two of the sections 12 of the strap 10 are provided with an aperture or socket 24 to receive one or more removable bars 26. It should be appreciated that it would be preferred that all sections 12 include such apertures as that tends to maximize the benefit of the variable weight toning strap 10.

As noted above, the strap sections 12 extend generally transversely of the length of the strap 10. The apertures would preferably extend in the elongated direction of the sections 12 and thus also extend transversely of the length of the strap 10. It should be appreciated, however, that the shape of the strap sections 12 and of the apertures all may be varied.

A plurality of bars 26 are also shown. The shape of each bar is generally the same as the length and shape of the aperture 24 such that the bar may be placed within the aperture. In the drawings, the bar is illustrated as being the shaped of a cylinder. The bars 26 are preferably the same length as the aperture, for ease of insertion and removal, and the same cross-sectional shape as the apertures such that a bar is frictionally retained within an aperture. The bars and apertures are illustrated as being of circular cross-section however it should be understood and appreciated that the specific shapes may be varied.

Preferably, the strap 10 is fabricated from a flexible material such as silicone or rubber. Other materials may be used regardless of whether naturally occurring, for example leather, or fabrics or synthetics. Metal and metal alloys may be used. Combinations of the above may be used.

The bars may be formed from a heavy metal such as bismuth, steel, or other similar metallic or other material. The bars need not be of the same weight and, in addition, some of the bars may be removable while other bars are non-removable.

To use the variable weight toning strap, a first bar 26 may be placed within a receptacle or aperture 24 and the strap 10 may be fastened to surround the wrist or ankle of the user. Normal movements by the user of the strap, throughout the day while the strap is being worn, will enhance muscle tone. At irregular or regular intervals, as desired, such as daily or weekly, additional bars may be added. If a user reaches the point where all the bars are being used, and further muscle tone is desired, bars of a heavier weight may be used.

The straps may be used in pairs, such as one on each wrist or one on each ankle (or four straps, one on each extremity).

Figure 5:
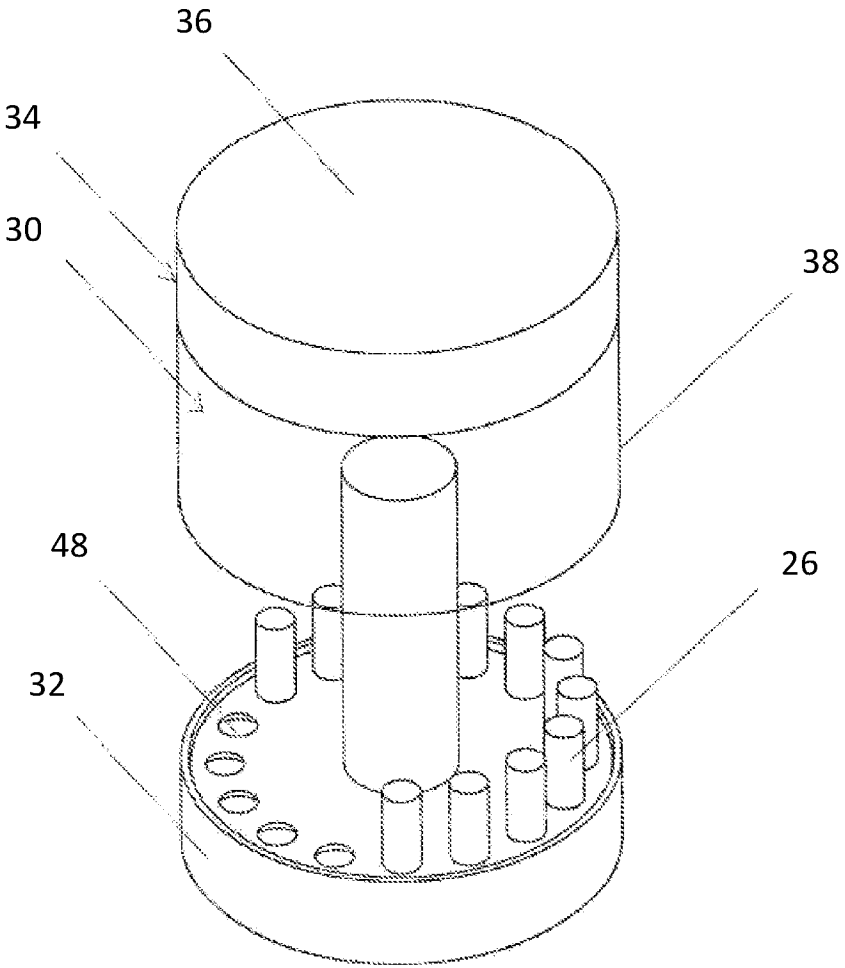
FIG. 5 is a partially exploded illustration of a variable weight toning strap storage unit.
Figure 6:
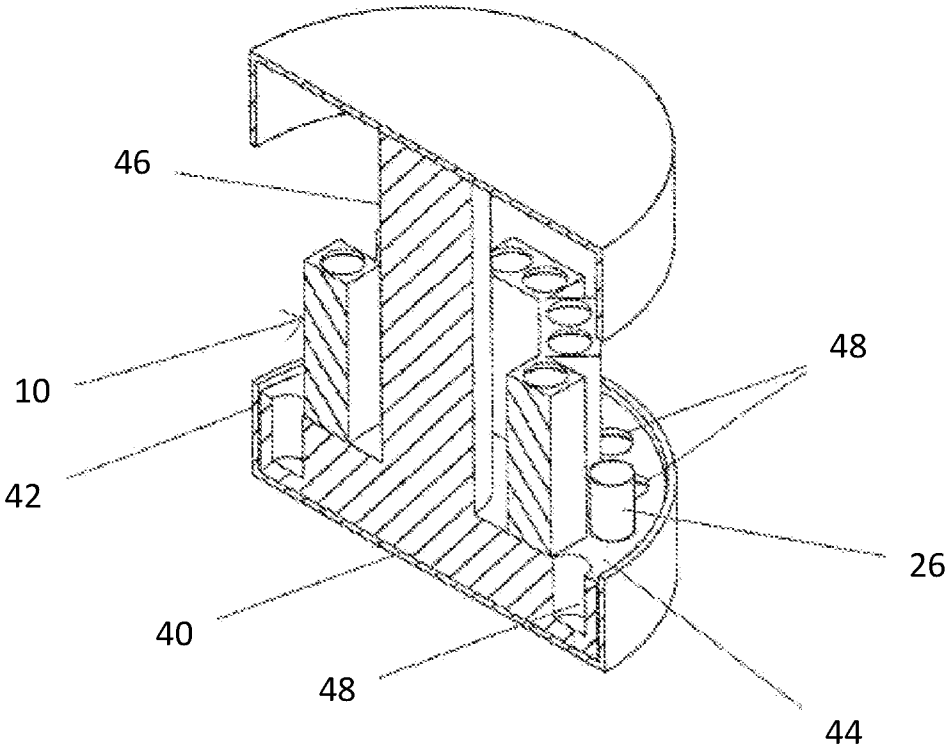
FIG. 6 is a partial perspective view of the variable weight toning strap storage unit.
Figure 7:
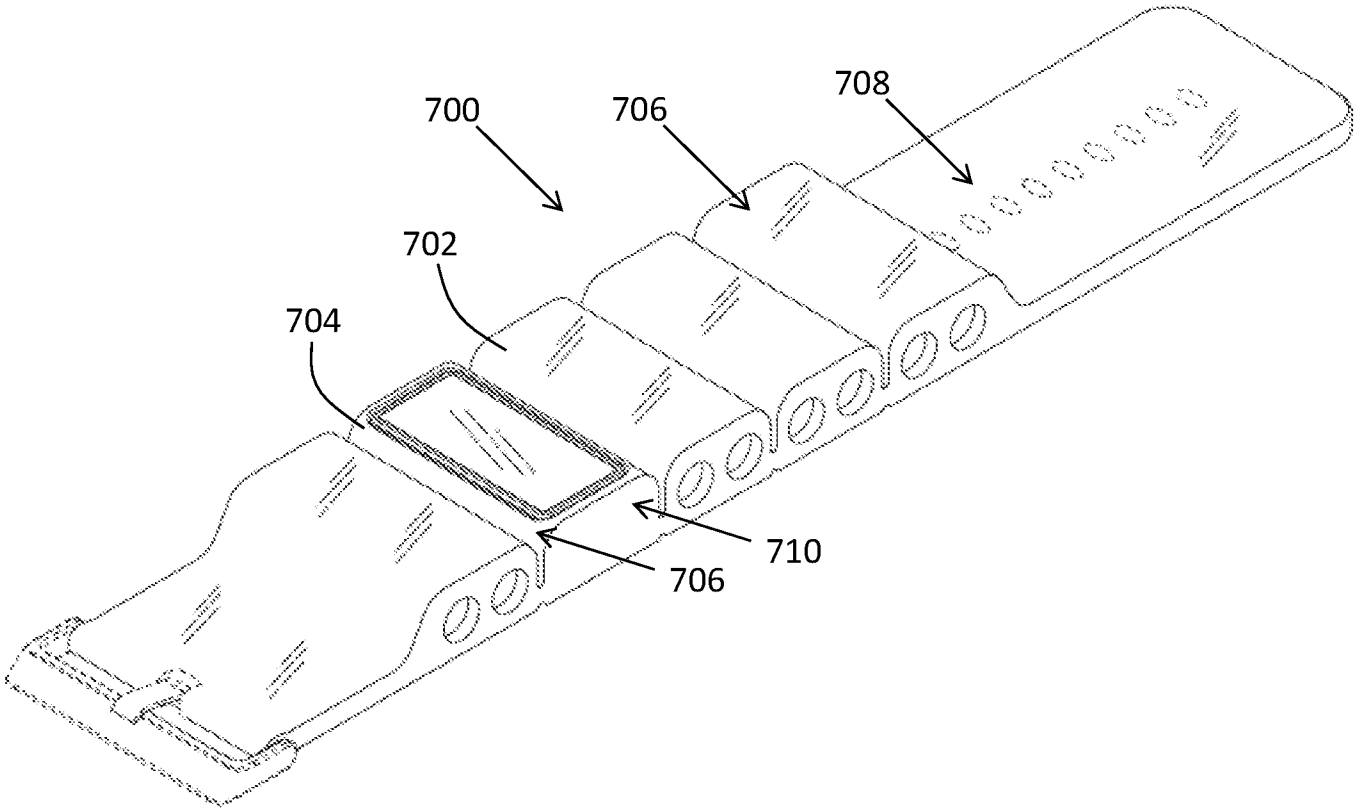
FIG. 7 is a perspective downward-looking view of a variable weight toning strap having an ECU assembly housed therein in accordance with one embodiment with the present invention.

Referring next to FIGS. 5 and 6, details of a variable weight toning strap storage unit will be described. The storage unit 30 may be in the form of a cylinder having a base 32 and removable portion 34. The removable portion includes a generally flat top 36 and circular side walls 38. The storage unit base 32 may also include a flat bottom 40 and upwardly extending side walls 42. The base 32 and removable portion 34 are interfitted such as by a friction fit or a twist fit to remain secured together as desired.

The storage unit 30 includes a first generally circular ledge or shoulder 44 spaced above the base 32. A circular rod 46 extends upwardly either from the base 32 through the ledge 44 or upwardly from the ledge 44. The ledge includes a series of vertical apertures 48 about its periphery. The apertures are configured in size and shape to receive and frictionally retain the bars. The two ends of the strap may be engaged, or alternatively the strap may just be formed as a circle and, in either situation, the strap is placed around the rod 46. The vertical apertures are spaced sufficiently far, radially, from the rod, such that the rod and surrounding strap do not interfere with the use of the apertures 48.

Figure 2:
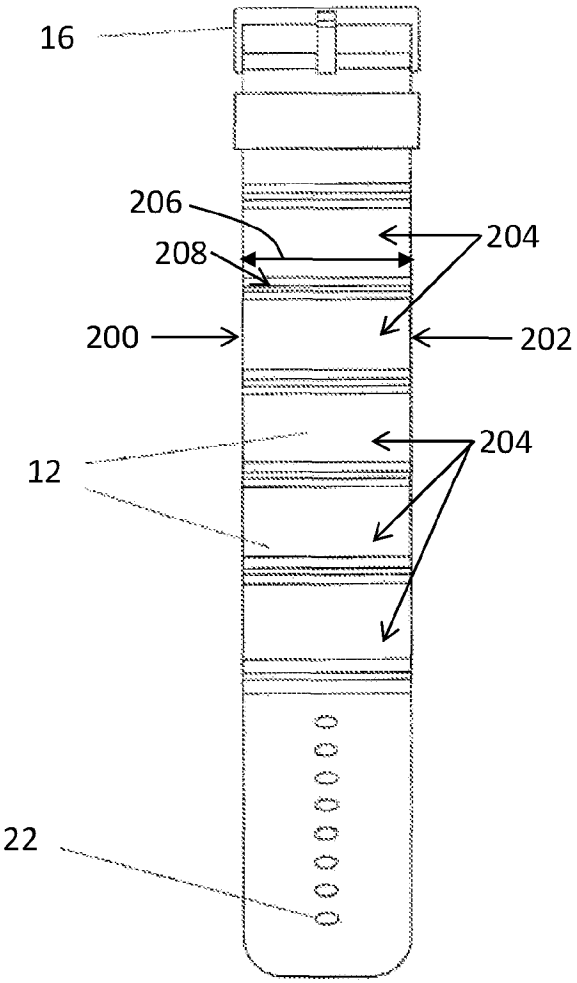
FIG. 2 is a plan view of the toning strap of FIG. 1.

With reference back to FIGS. 1-3, the variable weight toning strap 10 can be seen having an upper surface 28, a bottom surface 800 (best shown in FIG. 8), a first end 300, a second end 302 opposing the first end 300, and a flexible member length 304 separating the first and second ends 300, 302 of the flexible member 10. The upper and bottom surfaces 28, 800 spanning the flexible member length 304. As described above, the plurality of generally rectangular sections 12, also referred to as a "ridged-sections" 12, are disposed transversely along the flexible member length 304. Said another way, the ridged-sections 12 are oriented such that the front and rear faces 200, 202 are disposed to face in a direction that is substantially perpendicular (90°+/−5°) to the longitudinal direction of the flexible member 10, or along the length 304. A section width 206 can also be seen separating the front and rear faces 200, 202 of the sections 12. As best shown in FIG. 2, the section width 206 is of a length that is the same as the flexible member 10 or strap portion.

The ridged-sections 12 can also be seen disposed in a raised position transversely along the length 304 of the strap 10. Said another way, the sections 12 are elevated above the strap portion or tab 20 to accommodate the weights 26 housed therein, yet providing a comfortable and practical strap 10 for use by the user. When the tab 20 is joined with the buckle, or when the strap 10 is otherwise configured for use by the user to surround the wrist-arm area of a user, i.e., the "wearing position," those skilled in the art will appreciate the strap length becomes circumferential, and is hereinafter referred to as the "circumferential member length." The strap 10 can house approximately 2 lb of weights 26 in one embodiment because the strap 10 may have the plurality of ridged-sections disposed transversely along at least 75% of the circumferential member length.

Each of the top surfaces 204 of the ridged-sections 12 can be seen defining the upper surface 28 of the flexible member. Each of the ridged-sections 12 can be seen having one or more perpendicular sidewalls 306 extending in a direction substantially perpendicular to the top surface 204. The sidewalls 306 on two adjacent ridged sections 12 can be seen beneficially defining a discontinuous upper slit 308 so as to permit the ridged-sections 12, which are of a flexible material, to enter and egress into the slit 308 as the flexible member 10 is in use. Specifically, unlike those known weighted straps, the configuration of the ridged-sections 12 provides more comfort and versatility to the user while he or she is engaged in exercising, sports, or other activities. Said differently, while a user is engaged in an exercise, for example, that requires his or her hands to be placed and oriented in various angles, it will be appreciated by those of skill in the art that any bracelet, watch, or other strap surrounding the user's wrist will either shift during the exercise and/or inhibit or cause discomfort to the user in the range of motion for the user's wrist. This inhibition or discomfort is exacerbated when utilizing weighted straps because of the additional weight of the strap. As the flexible member 10, including the sections 12, are flexible, the shifting of the strap 10 and sections 12 during a user's exercise routine employing wrist or hand movements advantageously does not cause discomfort or inhibit the user's range of motion because of the configuration of the sections 12 and the ability of the sections 12 to navigate into the upper slit 308 while the user is utilizing the strap 10.

The upper slit 308 is discontinuous in that it terminates into a valley 208 interposed between two of the plurality of sections 12, wherein the valley 208 can also be seen partially defining the upper surface 28 of the flexible member 10 as well. The upper slit 308 can be seen spanning the section width 206 of each the plurality generally rectangular sections 12 defining the upper slit 308. The upper slit 308 can also be seen forming a generally rectangular volume between two sections 12, so as to maximize spacing, yet provide sufficient room for the sections 12 to flex into the slit 308.

Figure 3:
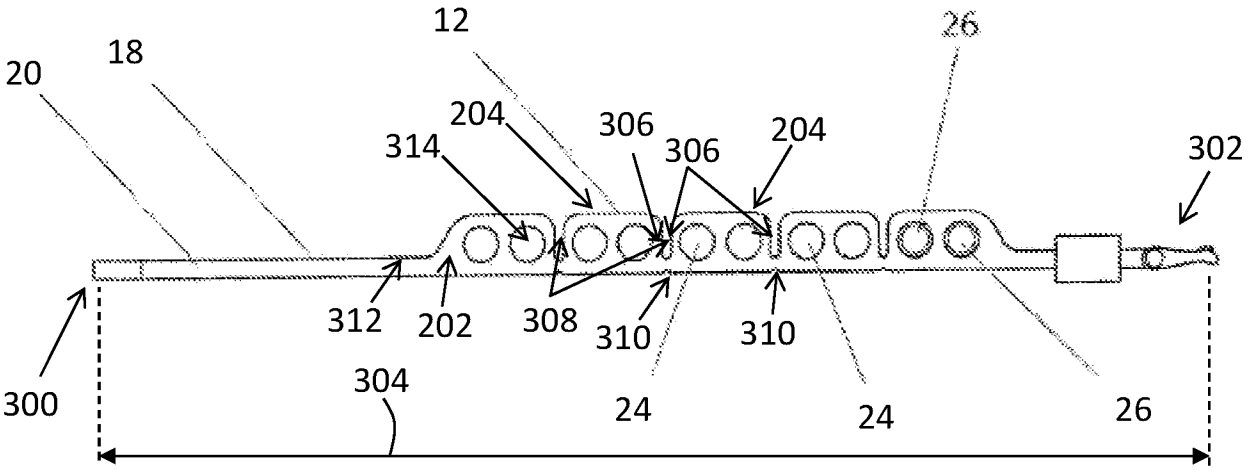
FIG. 3 is an elevation view of the toning strap of FIG. 1 with two weight bars in place.
Figure 8:
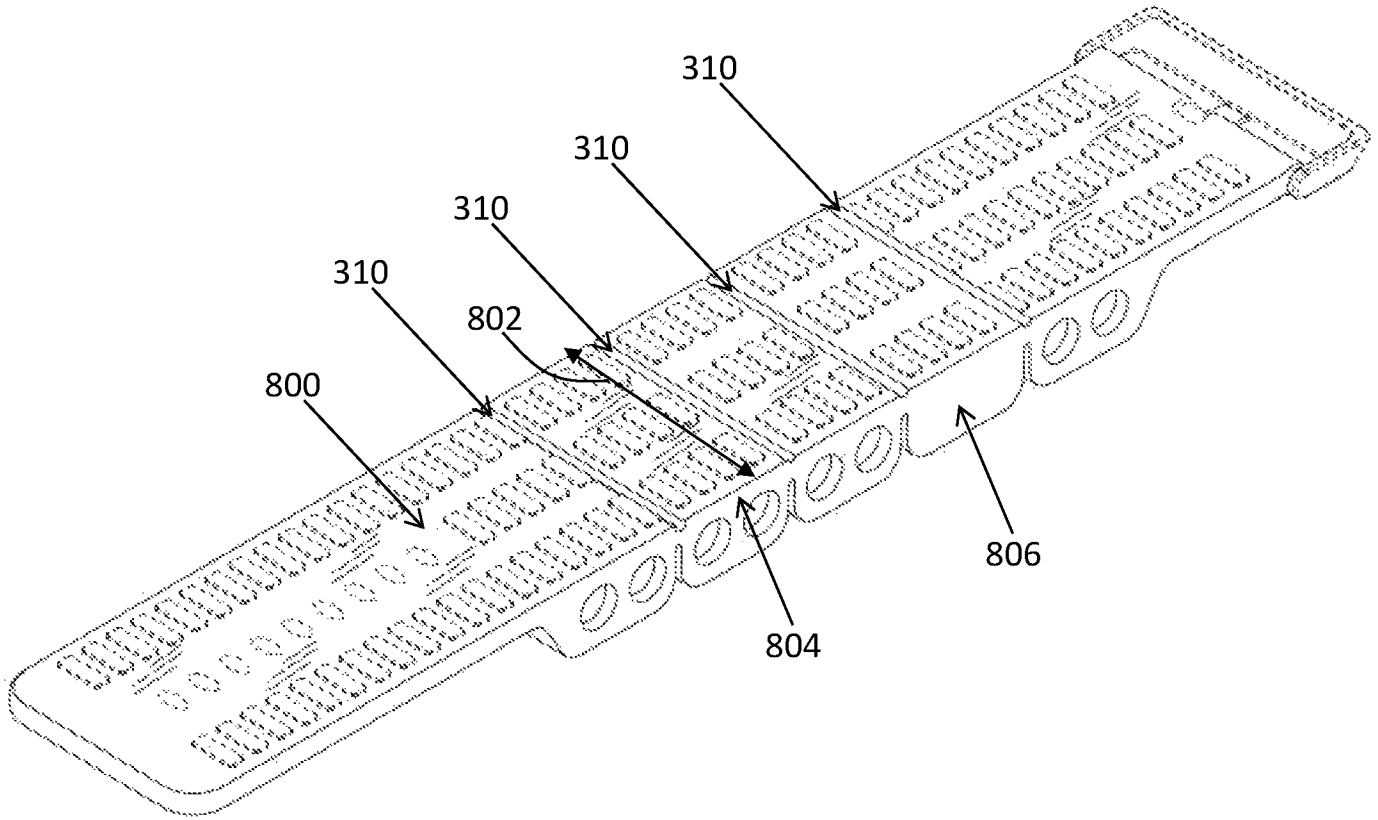
FIG. 8 is a perspective upward-looking view of the variable weight toning strap of FIG. 7.
Figure 9:
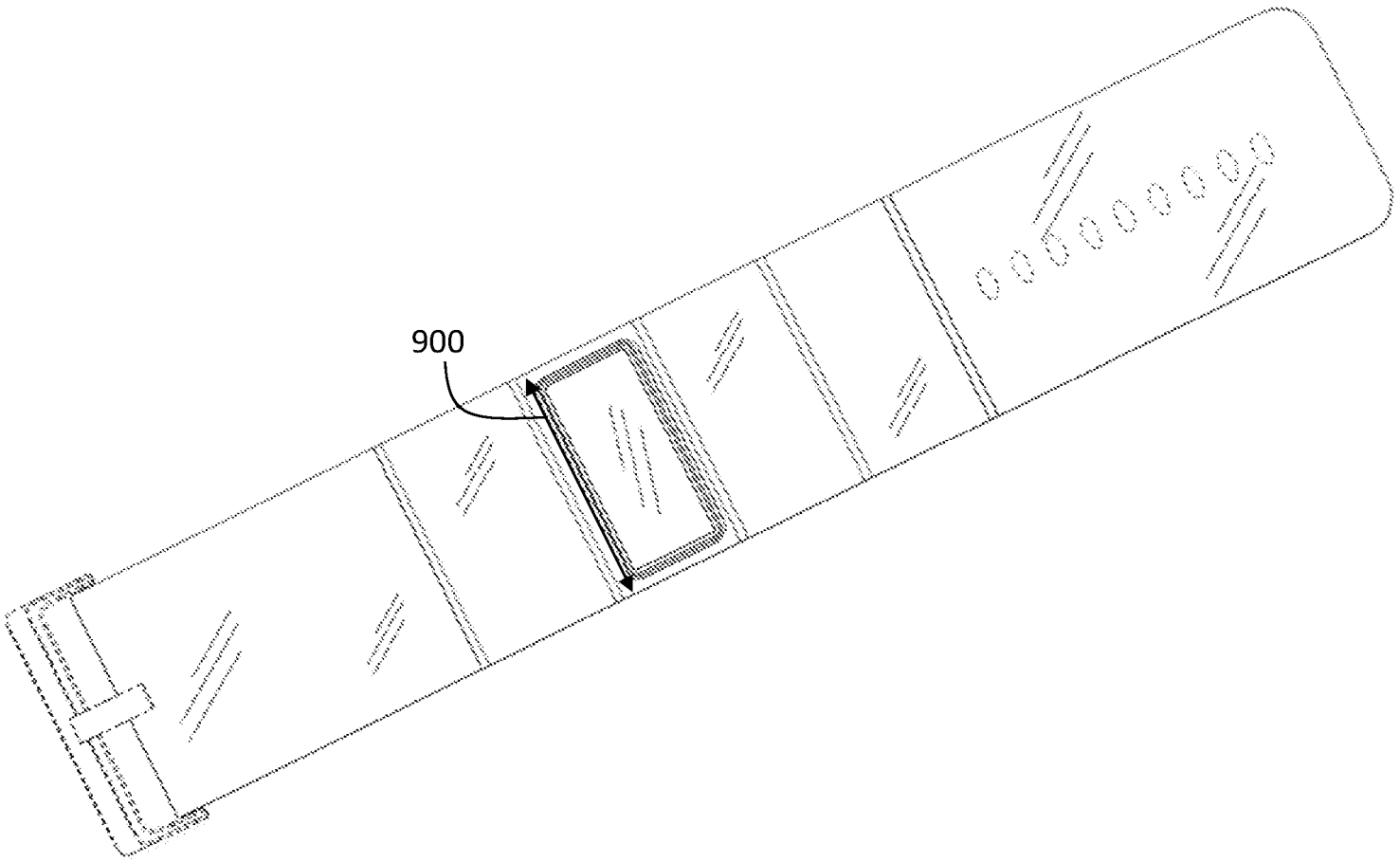
FIG. 9 is a top plan view of the variable weight toning strap of FIG. 7.
Figure 10:
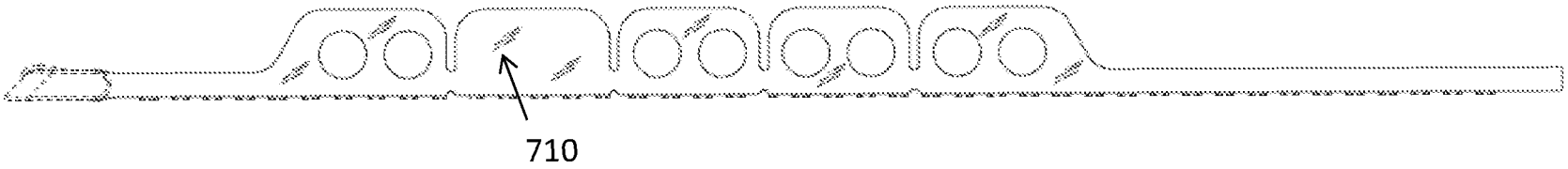
FIG. 10 is an elevational side view of the variable weight toning strap of FIG. 7.
Figure 11:
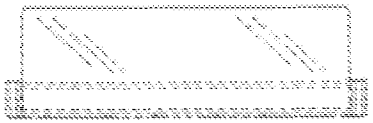
FIG. 11 is an elevational front view of the variable weight toning strap of FIG. 7.

With brief reference to FIGS. 3 and 8, to provide further comfort and versatility to a user, the strap 10 can also be seen having at least one discontinuous lower slit 310 defined by the bottom surface 800 (shown in FIG. 8) of the flexible member 10. The lower slit 310 can be seen spanning a transverse width 802 separating a front face 804 and a rear face 312 of the flexible member 10 and is aligned with the upper slit 308. In one embodiment, the upper and lower slits 308, 310 are approximately 0.05-0.2" in width. The upper slit 308 may have a depth of approximately 0.5-1.5" and the lower slit 310 may have a depth of approximately 0.05-0.2". As such, the section members 12 are easily permitted to contract and expand around the user's wrist with comfort during a workout routine, sports, or other activities. The flexible member 10 can also be seen with only a small piece of the strap portion of the flexible member separating the sections 12 along the length 304. To effectuate the configuration and movement of the sections 12 relative to one another, the flexible member and the plurality of generally rectangular or ridged sections are unitary, or formed from a single piece of material, such as rubber.

Figure 4:
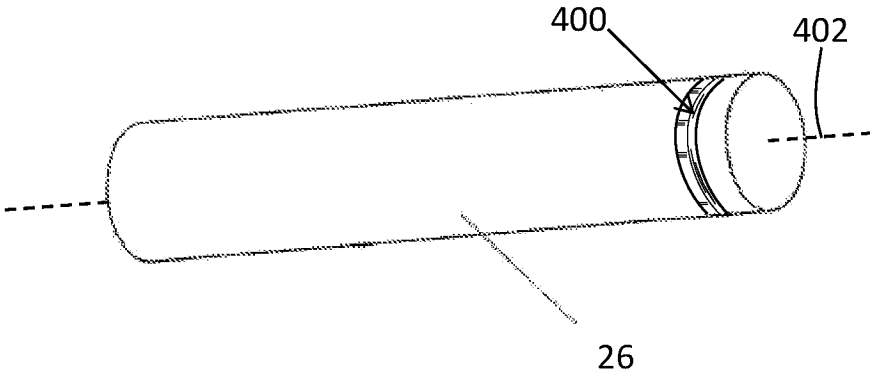
FIG. 4 is a perspective view of one form of an individual weight bar for the variable weight toning strap.

With reference back to FIGS. 1-3, the strap 10 is capable of retaining a plurality of weights 26 that are able to be inserted and frictionally retained within the sockets 24, or "channels," that terminate into entrance and exit apertures 29, 314 allowing the weights 26 to be inserted and removed effectively. With brief reference to FIG. 4 in combination with FIG. 3, to effectuate removal of the weights 26 when frictionally retained by the sections 12 the weights 26 may define a recess 400 or notch that may circumferentially surround the weights 26. As the frictional resistance caused by the flexible sections 12 can be high, the recess 400 or notch provides a user the ability to grasp onto something in order to remove the weight 26. As such the recess 400 or notch is preferably disposed substantially adjacent (within +/−0.5") to the terminal end of the weight 26.

The weights 26 may also include a longitudinal axis (represented by axis 402 in FIG. 4) defined by at least one point that is defined by either the centroid (geometric center) or center of mass of the weights 26. To save space and provide a device that can store an appreciable amount of weight, the longitudinal axis 402 of two of the plurality of weights 26 are removably frictionally retained by the plurality of channels of one of the plurality of generally rectangular sections 12 are parallel and coplanar with one another.

With reference now to FIGS. 7-13 another embodiment of a flexible strap member 700 can be seen. Specifically, the strap 700 may have a plurality of ridged-sections 702, as described above, in addition to advantageously having a ridged-modular section 704. The ridged-modular section 704 has the ability to house a variety of different structures desired for users, such as an electronic display, interchangeable pins, buttons, or other expressive indicia, or using it as a storage area for personal items such as a house hey. The ridged-modular section 704 may be generally rectangular in shape as described above for the other ridged-sections 12. The modular section 704 is also disposed transversely along the flexible member length and includes a top surface 706 at least partially defining the upper surface 708 of the flexible member 700. The modular section 704 can also have at least one perpendicular sidewall extending in a direction substantially perpendicular to the top surface 706, a front face 710, a rear face 806, opposing the front face 710, and a section width 900 separating the rear and front faces 806, 710. The modular section 704 also defines an internal cavity 1202 where, for example, an electronic control unit (ECU) assembly 1200 can be disposed therein. The internal cavity 1202 may be of a rectangular shape or any other shape desired to effectuate the features described herein.

Figure 12:
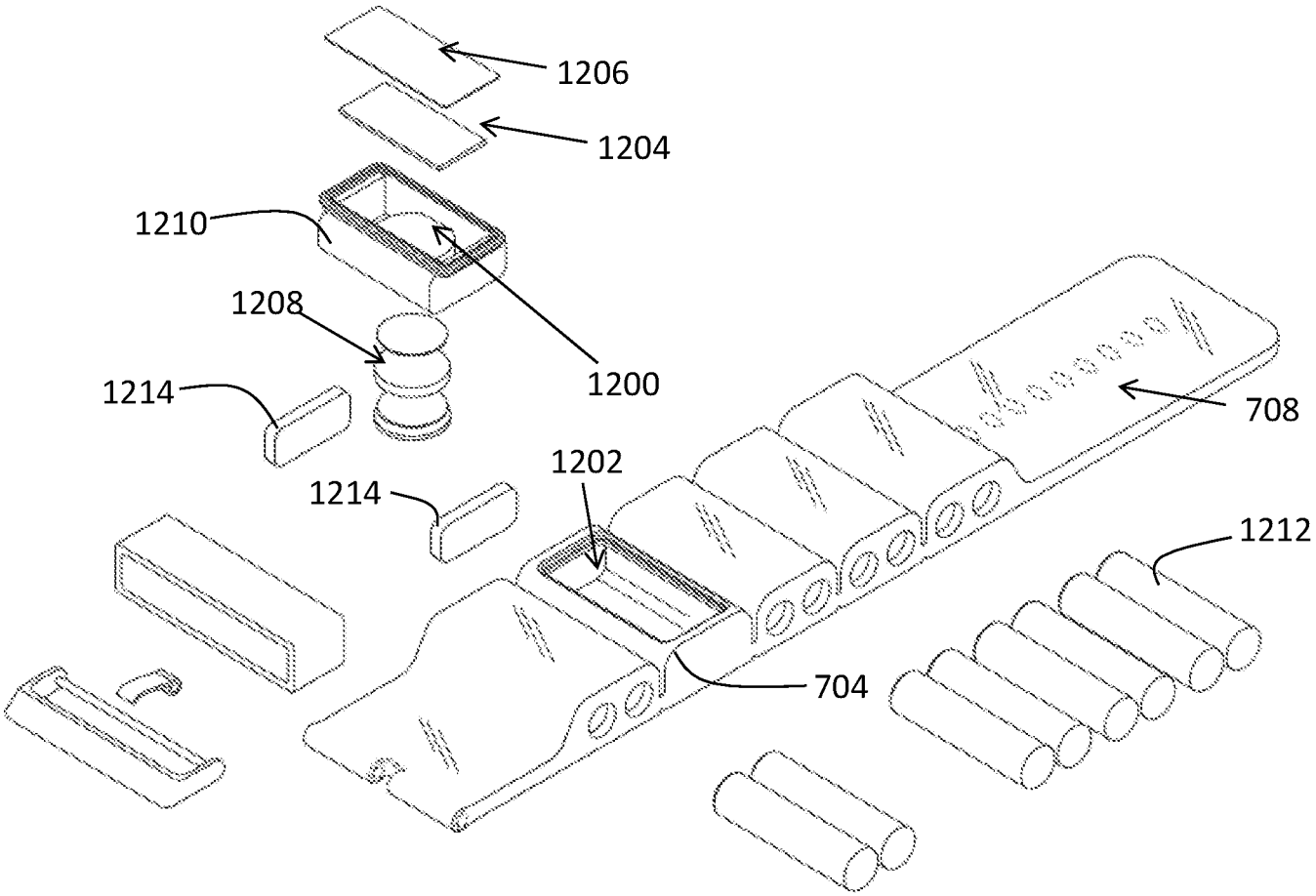
FIG. 12 is an exploded view of the variable weight toning strap of FIG. 7.

An exemplary electronic control unit ("ECU") assembly 1200 can be seen in FIG. 12 and may have a digital display 1204 with top surface 1206 at least partially defining the upper surface 708 of the flexible member 700 and a power source 1208, e.g., batteries, electrically coupled to the display 1204. The ECU assembly 1200 may include a user-interface and may utilize a processor operable to execute a variety of programs, as will be appreciated by those of skill in the art. For example, the display 1204 may be operably configured to generate the time, date, calendar of the user, a flashlight, among a variety of other features. When utilized with one or more sensors, the ECU assembly 1200 may also be operably configured to determine and display the user's heartbeat, blood pressure, among a variety of other features to track the user. The ECU assembly 1200 may also be operable to calculate the weight carried by strap 10 and estimate the toning effect, e.g., calories burned, on the user from carrying said weight. The ECU assembly 1200 may also be operably configured to store a user's music on a memory and may include a jack, or outlet, configured for use with headphones or ear buds. The ECU assembly 1200 may also utilize one or more local communication protocols such as Bluetooth.

The ECU assembly 1200 may also include an ECU housing 1210 shaped and sized to correspond to the internal cavity 1202 of the modular section 704. As with the weights 1212, the ECU housing 1210 may be selectively removably and frictionally retained by the modular section 704. As such, a user may beneficially interchange various devices and components within the cavity 1202 of the modular section 704, which aesthetically may look the same as the other sections 702. While the modular section 704 is shown in one embodiment without any apertures defined by the faces 710, 806 in FIGS. 7-12, in other embodiments the modular section 704 is formed, similar to sections 702, with one or more apertures and through-holes, or channels, as shown in FIG. 13.

Figure 13:
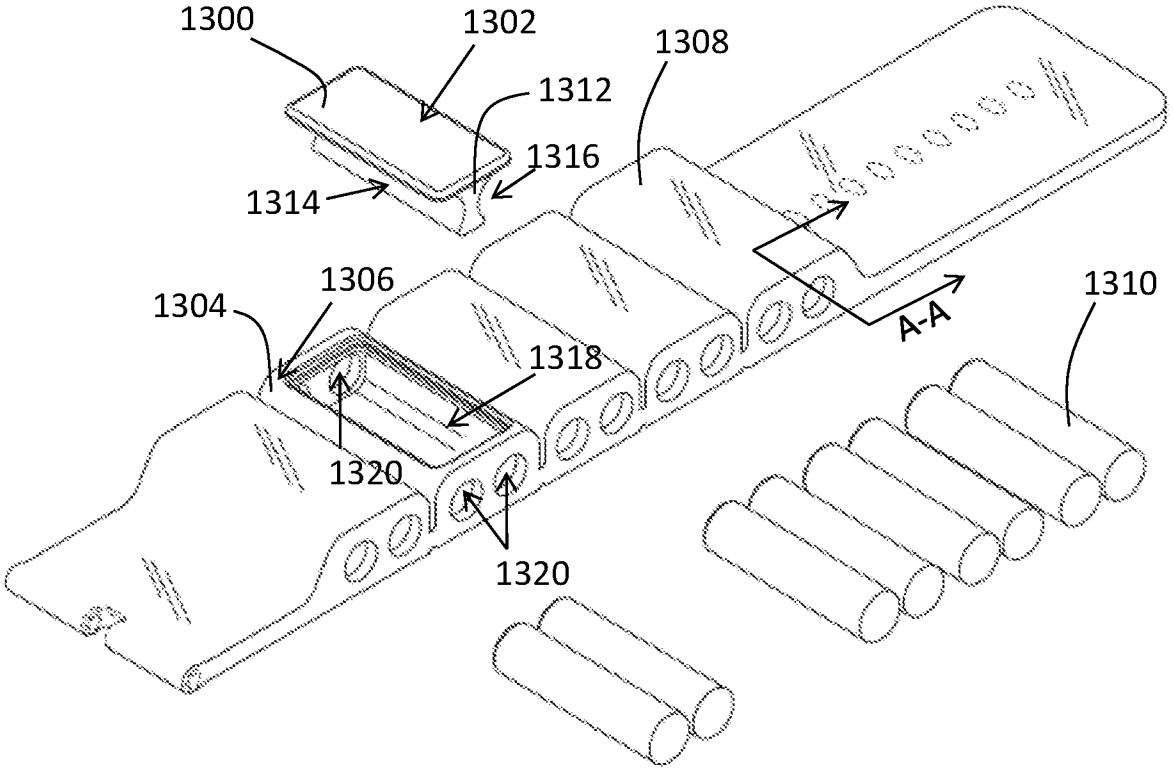
FIG. 13 is an exploded view of a variable weight toning strap utilizing a modular section insert in accordance with another embodiment of the present invention.

Specifically, as shown in FIG. 13, the modular section 704 may beneficially include a modular section insert 1300 having an upper surface 1302 shaped and sized to be selectively removably and frictionally retained by the modular section 1304. In one embodiment, the upper surface 1302 is coplanar with the upper surface 1306 of the modular section 1304 to give an appearance that it is another ridged-section, e.g., section 1308, holding one or more weights, e.g., weight 1310. Advantageously, the modular section insert 1300 may include a partition wall 1312 disposed at a substantially perpendicular orientation with respect to the upper surface 1302 of the module section insert 1300. To accommodate the one or more weights 1310, the partition wall 1312 of the modular section insert 1300 can be seen having opposing symmetrical side surfaces 1314, 1316 shaped to at least partially contour a plurality of weights 1310 housed within the internal cavity of the modular section 1304. As shown in FIG. 13, because the weights 1310 are cylindrical, the symmetrical side surfaces 1314, 1316 can be seen being of an arcuate shape to help frictionally retain the weights 1310 when inserted therein. As such, when the user desires more weight, the modular section 1304 may be utilized like the other sections 1308.

Figure 14:
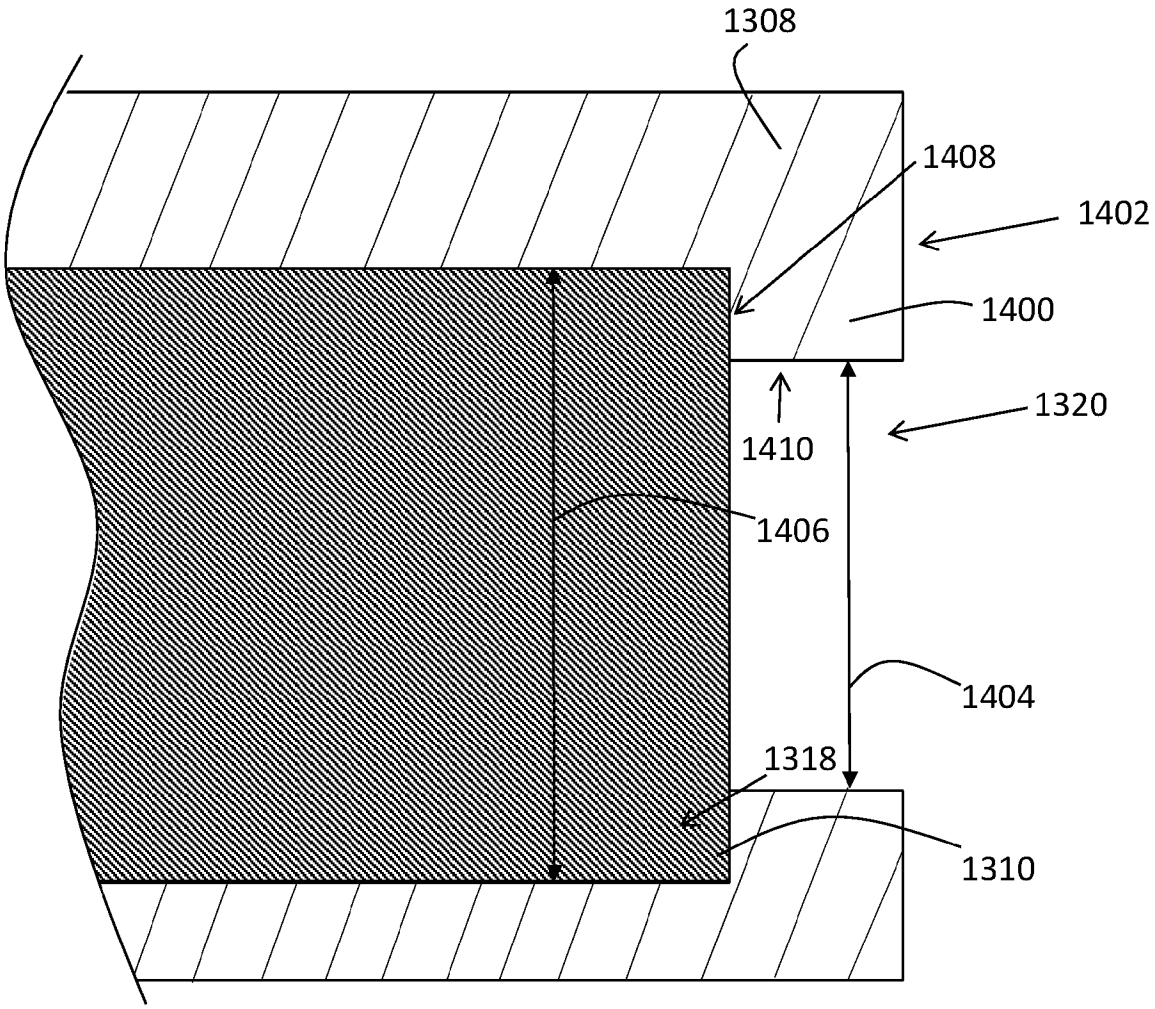
FIG. 14 is an enlarged cross-sectional view, along A-A in FIG. 13, of a ridged-section with a weight frictionally retained therein in accordance with an embodiment of the present invention.

With brief reference to FIG. 14, an enlarged cross-sectional view along A-A in FIG. 13 can be seen. As illustrated in FIG. 14, the ridged-sections 1308 can be seen configured and shaped to retain the one or more weights 1310 in a more effective and secure way, thereby reducing the likelihood of the weights being involuntarily removed through movements by the user. Specifically, the ridged-section 1308 can be seen defining a flange 1400 or lip that may surround the distal end 1402 of the ridged-section and defines the entrance aperture 1320 into the cavity 1318 or channel. As such, the entrance aperture 1320 has a diameter 1404 or width that is less than the diameter 1406 or width of the channel 1318. The flange 1400 advantageously restricts lateral movement of the weight 1310 unless elastically deformed—as it is flexible—by the user to, for example, remove the weight 1310 from the channel 1318. As such, the flange 1400 can also be seen having an inner wall 1408 contacting the weight 1310 and an aperture surface 1410 defining an entrance or exit aperture 1320.

With reference to FIGS. 12-13, when the user desires to employ the ECU assembly 1200, the user removes the insert 1300 and inserts the ECU assembly 1200. With reference back to FIG. 12, to give an appearance that the modular section 1304 is still being utilized for use with weights one or more weights 1212—in an effort to deter theft of the ECU assembly 1200 among other benefits, the assembly 1200 may also utilize metal blanks 1214 flanking the housing 1210 and visibly exposed through the apertures 1320. The upper surface 1302 of the insert 1300 may employ a variety of indicia, such as user's favorite sports team logo, the user's alma mater, the user's flag representing his or her nationality, among other indicia. In further embodiments, when the ECU assembly 1200 is not utilized with the modular section 1304, the cavity 1318 may be of a sufficient size to house a user's portable media player.

As such, a variable weight toning strap has been disclosed that solves many, if not all, of the problems experienced by those known variable weight straps. The strap enables a user to effectively, efficiently, and comfortably retain a variable amount of desired weight without inhibiting the user's exercise routine or other activity while utilizing the variable weight toning strap. Moreover, the variable weight toning strap also enables users interchange a variety components or devices, such as an electronic display, advertising indicia, or personalized user-content, to effectuate a customized configuration desired by the user.

What is claimed is:

1. A variable weight toning strap comprising:

a flexible member having an upper surface, a bottom surface, a first end, a second end opposing the first end, and a flexible member length separating the first and second ends of the flexible member, the upper and bottom surfaces spanning the flexible member length;

a plurality of generally rectangular sections:

each disposed transversely along the flexible member length;

each including a top surface at least partially defining the upper surface of the flexible member, at least one perpendicular sidewall extending in a direction substantially perpendicular to the top surface, a front face, a rear face opposing the front face, and a section width separating the rear face and the front face;

having a discontinuous upper slit defined by the at least one perpendicular sidewall of each of the plurality of generally rectangular sections flanking the upper slit, the upper slit spanning the section width of each the plurality generally rectangular sections defining the upper slit and terminating into a valley that at least partially defines the upper surface of the flexible member;

at least one discontinuous lower slit defined by the bottom surface of the flexible member, the lower slit spanning a transverse width separating a front face and a rear face of the flexible member and aligned with the upper slit; and each defining a channel spanning transversely along the flexible member length in direction from the front face to the rear face of each of the plurality of generally rectangular sections; and a plurality of weights, with one of the plurality of weights each selectively and removably retained within each respective channel of one of the respective plurality of generally rectangular sections.

2. The variable toning strap of claim 1, wherein:

each of the plurality of weights is selectively removably and frictionally retained within each respective channel of one of the respective plurality of generally rectangular sections.

3. The variable weight toning strap of claim 1, wherein:

the flexible member and the plurality of generally rectangular sections are unitary.

4. The variable weight toning strap of claim 1, wherein the plurality of generally rectangular sections each further comprise:

a flange disposed within each respective channel of one of the respective plurality of generally rectangular sections and at least partially defining the front face of the respective plurality of generally rectangular sections, the flange restricting lateral movement of one of the respective plurality of weights removably and frictionally retained therein.

5. The variable weight toning strap of claim 1, wherein:

the plurality of generally rectangular sections each define an entrance aperture on the front face of each of the plurality of generally rectangular sections and an exit aperture on the rear face of each of the plurality of generally rectangular sections, the entrance and exit apertures disposed at respective ends of the respective channel of one of the respective plurality of generally rectangular sections to permit entrance and egress of one of the plurality of weights.

6. The variable weight toning strap of claim 1, wherein the plurality of weights each further comprise:

a longitudinal axis defined by at least one point defined by at least one of a centroid and center of mass of the respective plurality of weights, the longitudinal axis of each of the plurality of weights retained within each of the respective channels of the respective plurality of generally rectangular sections are parallel and coplanar with one another.

7. The variable weight toning strap of claim 1, further comprising:

a generally rectangular modular section disposed transversely along the flexible member length and including a top surface at least partially defining the upper surface of the flexible member, at least one perpendicular sidewall extending in a direction substantially perpendicular to the top surface of the modular section, a front face, a rear face opposing the front face of the modular section, and a section width separating the rear face and the front face of the modular section, the modular section defining an internal cavity; and an electronic control unit (ECU) assembly disposed within the internal cavity of the modular section and having a digital display with top surface at least partially defining the upper surface of the flexible member and a power source electrically coupled to the display.

8. The variable weight toning strap of claim 7, wherein the electronic control unit assembly further comprises:

an ECU housing shaped and sized to correspond to the internal cavity of the modular section, the ECU housing selectively removably and frictionally retained by the modular section.

9. The variable weight toning strap of claim 1, further comprising:

a generally rectangular modular section disposed transversely along the flexible member length and including a top surface at least partially defining the upper surface of the flexible member, at least one perpendicular sidewall extending in a direction substantially perpendicular to the top surface of the modular section, a front face, a rear face opposing the front face of the modular section, and a section width separating the rear face and the front face of the modular section, the modular section defining an internal cavity; and a modular section insert having an upper surface shaped and sized to be selectively removably and frictionally retained by the modular section, the modular section insert including a partition wall disposed at a substantially perpendicular orientation with respect to the upper surface of the modular section insert.

10. The variable weight toning strap of claim 9, wherein the partition wall of the modular section insert further comprises:

opposing symmetrical side surfaces shaped to at least partially contour at least one weight housed within the internal cavity of the modular section.

11. The variable weight toning strap of claim 10, wherein the generally rectangular modular section further comprises:

at least one entrance aperture defined by the front face of the modular section and an exit aperture defined by the rear face of the modular section, the entrance and exit apertures of the modular section providing entrance and egress to the internal cavity of the modular section.

12. A variable weight toning strap comprising:

a flexible member configured to enclose a wrist-arm area of a user to define a wearing position with a circumferential member length, the flexible member having a bottom surface in a user-contacting configuration with the user and an upper surface opposing the bottom surface;

a plurality of ridged-sections disposed in a raised position transversely along at least 75% of the circumferential member length, the plurality of ridged-sections:

each having a top surface at least partially defining the upper surface of the flexible member, at least one perpendicular sidewall extending in a direction substantially perpendicular to the top surface, a front face, and a rear face opposing the front face;

defining a discontinuous upper slit by the at least one perpendicular sidewall of two of the plurality of ridged-sections flanking the upper slit, the upper slit spanning from the front and rear faces of the two of the plurality of ridged-sections defining the upper slit and terminating into a valley that at least partially defines the upper surface of the flexible member; and each defining a channel spanning transversely along the circumferential member length in direction from the front face of the ridged-section to the rear face of the ridged-section, the channel terminating at an entrance aperture defined by the front face of the ridged-section and at an exit aperture defined by the rear face of the ridged-section; and a plurality of weights, with one of the plurality of weights selectively removably and frictionally retained with the channel of each of the respective plurality of ridged-sections.

13. The variable weight toning strap of claim 12, further comprising a discontinuous lower slit defined by the bottom surface of the flexible member, the discontinuous lower slit spanning a transverse width separating a front face and a rear face of the flexible member and aligned with the discontinuous upper slit.

14. A variable weight toning strap comprising:

a flexible member having an upper surface, a bottom surface, a first end, a second end opposing the first end, and a flexible member length separating the first and second ends of the flexible member, the upper and bottom surfaces spanning the flexible member length;

a plurality of ridged-sections disposed in a raised position along the flexible member length, the plurality of ridged-sections:

each disposed transversely along the flexible member length;

each including a top surface at least partially defining the upper surface of the flexible member, at least one sidewall extending downwardly from the top surface of the ridged-section, a front face, a rear face opposing the front face, and a section width separating the rear face and the front face;

having a discontinuous upper slit defined by the at least one sidewall of each of the plurality of ridged-sections flanking the upper slit, the upper slit spanning the section width of each the plurality ridged-sections defining the upper slit and terminating into a valley that at least partially defines the upper surface of the flexible member; and each defining a channel spanning transversely along the flexible member length in a direction from the front face to the rear face of each of the plurality of ridged-sections;

a plurality of weights, with one of the plurality of weights selectively removably retained with the channel of each of the respective plurality of ridged-sections;

a ridged-modular section disposed in a raised position along the flexible member length and including a top surface at least partially defining the upper surface of the flexible member, at least one sidewall extending in a downward direction away from the top surface of the ridged-modular section, a front face, a rear face opposing the front face of the ridged-modular section, and a section width separating the rear face and the front face of the ridged-modular section, the ridged-modular section defining an internal cavity; and an electronic control unit (ECU) assembly disposed within the internal cavity of the modular section and having a digital display with a top surface at least partially defining the upper surface of the flexible member and a power source electrically coupled to the display.

15. The variable weight toning strap of claim 14, further comprising a plurality of discontinuous lower slits defined by the bottom surface of the flexible member, each of the plurality of discontinuous lower slits spanning a transverse width separating a front face and a rear face of the flexible member and aligned with the discontinuous upper slit.

16. The variable weight toning strap of claim 14, wherein the electronic control unit assembly further comprises:

an ECU housing shaped and sized to correspond to the internal cavity of the ridged-modular section, the ECU housing selectively removably and frictionally retained by the ridged-modular section.

17. A variable weight toning strap comprising:

a flexible member having an upper surface, a bottom surface, a first end, a second end opposing the first end, and a flexible member length separating the first and second ends of the flexible member, the upper and bottom surfaces spanning the flexible member length;

a plurality of generally rectangular sections:

each disposed transversely along the flexible member length;

each including a top surface at least partially defining the upper surface of the flexible member, at least one perpendicular sidewall extending in a direction substantially perpendicular to the top surface, a front face, a rear face opposing the front face, and a section width separating the rear face and the front face;

having a discontinuous upper slit defined by the at least one perpendicular sidewall of each of the plurality of generally rectangular sections flanking the upper slit, the upper slit spanning the section width of each the plurality generally rectangular sections defining the upper slit and terminating into a valley that at least partially defines the upper surface of the flexible member;

each defining at least one channel spanning transversely along the flexible member length in a direction from the front face to the rear face of each of the plurality of generally rectangular sections; and a flange disposed within each of the at least one channel and at least partially defining the front face of the respective plurality of generally rectangular sections; and a plurality of weights, with one of the plurality of weights selectively removably retained within the at least one channel of each respective generally rectangular section and, when retained within the at least one channel, restricted from lateral movement by the flange disposed therein.

18. A variable weight toning strap comprising:

a flexible member having an upper surface, a bottom surface, a first end, a second end opposing the first end, and a flexible member length separating the first and second ends of the flexible member, the upper and bottom surfaces spanning the flexible member length;

a plurality of generally rectangular sections:

each disposed transversely along the flexible member length;

each including a top surface at least partially defining the upper surface of the flexible member, at least one perpendicular sidewall extending in a direction substantially perpendicular to the top surface, a front face, a rear face opposing the front face, and a section width separating the rear face and the front face;

having a discontinuous upper slit defined by the at least one perpendicular sidewall of each of the plurality of generally rectangular sections flanking the upper slit, the upper slit spanning the section width of each the plurality generally rectangular sections defining the upper slit and terminating into a valley that at least partially defines the upper surface of the flexible member;

each defining at least one channel spanning transversely along the flexible member length in direction from the front face to the rear face of each of the plurality of generally rectangular sections; and each defining an entrance aperture on the front face of each respective plurality of generally rectangular sections and an exit aperture on the rear face of each respective plurality of generally rectangular sections, the entrance and exit apertures disposed at respective ends of the at least one channel; and a plurality of weights, with one of the plurality of weights respectively selectively removably retained within the at least one channel of each generally rectangular section and operably configured to enter and egress respectively through the entrance and exit apertures.

19. A variable weight toning strap comprising:

a flexible member having an upper surface, a bottom surface, a first end, a second end opposing the first end, and a flexible member length separating the first and second ends of the flexible member, the upper and bottom surfaces spanning the flexible member length;

a plurality of ridged-sections:

each disposed transversely along the flexible member length;

each including a top surface at least partially defining the upper surface of the flexible member, at least one perpendicular sidewall extending in a direction substantially perpendicular to the top surface, a front face, a rear face opposing the front face, and a section width separating the rear face and the front face;

having a discontinuous upper slit defined by the at least one perpendicular sidewall of each of the plurality of ridged-sections flanking the upper slit, the upper slit spanning the section width of each the plurality of ridged-sections defining the upper slit and terminating into a valley that at least partially defines the upper surface of the flexible member; and each defining at least one channel spanning transversely along the flexible member length in direction from the front face to the rear face of each of the plurality of ridged-sections; and a plurality of weights, one of the plurality of weights selectively removably and frictionally retained within the at least one channel of each of the plurality of ridged-sections;

a modular section disposed transversely along the flexible member length and including a top surface at least partially defining the upper surface of the flexible member, at least one perpendicular sidewall extending in a direction substantially perpendicular to the top surface of the modular section, a front face, a rear face opposing the front face of the modular section, and a section width separating the rear face and the front face of the modular section, the modular section defining an internal cavity; and a modular section insert having an upper surface shaped and sized to be selectively removably and frictionally retained by the modular section, the modular section insert including a partition wall disposed at a substantially perpendicular orientation with respect to the upper surface of the module section insert.

* * * * *